US009573745B2

(12) United States Patent
Olsen

(10) Patent No.: US 9,573,745 B2
(45) Date of Patent: Feb. 21, 2017

(54) CONTAINER CARRIER

(75) Inventor: Robert C. Olsen, Medinah, IL (US)

(73) Assignee: Illinois Tool Works Inc., Glenview, IL (US)

( * ) Notice: Subject to any disclaimer, the term of this patent is extended or adjusted under 35 U.S.C. 154(b) by 779 days.

(21) Appl. No.: 12/364,280

(22) Filed: Feb. 2, 2009

(65) Prior Publication Data

US 2009/0223171 A1 Sep. 10, 2009

Related U.S. Application Data

(60) Provisional application No. 61/033,640, filed on Mar. 4, 2008.

(51) Int. Cl.
*B65D 71/50* (2006.01)

(52) U.S. Cl.
CPC ..... *B65D 71/504* (2013.01)

(58) Field of Classification Search
CPC ..... B65D 71/50; B65D 71/502; B65D 71/504; B65D 71/506
USPC ..... 206/141–143, 145–151, 161–162, 192,206/427; 294/87.2
See application file for complete search history.

(56) References Cited

U.S. PATENT DOCUMENTS

| | | | | | |
|---|---|---|---|---|---|
| 4,219,117 | A * | 8/1980 | Weaver et al. | ..... | 206/150 |
| 4,330,058 | A * | 5/1982 | Klygis | ..... | 206/150 |
| 4,740,415 | A * | 4/1988 | Hirschberger | ..... | 428/212 |
| 4,782,955 | A * | 11/1988 | Weaver et al. | ..... | 206/161 |
| 5,261,530 | A * | 11/1993 | Marco | ..... | 206/150 |
| 5,651,453 | A * | 7/1997 | Olsen | ..... | 206/150 |
| 5,655,654 | A * | 8/1997 | Broskow | ..... | 206/150 |
| 6,056,115 | A * | 5/2000 | Olsen | ..... | 206/150 |
| 6,148,994 | A * | 11/2000 | Olsen | ..... | 206/150 |
| 6,170,652 | B1 * | 1/2001 | Olsen | ..... | 206/150 |
| 6,182,821 | B1 * | 2/2001 | Olsen | ..... | 206/150 |
| 6,230,880 | B1 * | 5/2001 | Marco et al. | ..... | 206/150 |
| 6,598,738 | B2 * | 7/2003 | Weaver | ..... | 206/150 |
| 6,779,655 | B2 * | 8/2004 | Olsen et al. | ..... | 206/150 |
| 6,969,098 | B2 * | 11/2005 | Olsen | ..... | 294/87.2 |
| 7,074,476 | B2 * | 7/2006 | Weaver et al. | ..... | 428/131 |
| 7,510,074 | B2 * | 3/2009 | Weaver et al. | ..... | 206/150 |
| 7,510,075 | B2 | 3/2009 | Olsen et al. | | |
| 2005/0077194 | A1 * | 4/2005 | Marco et al. | ..... | 206/139 |
| 2006/0118432 | A1 * | 6/2006 | Weaver et al. | ..... | 206/150 |
| 2006/0289315 | A1 | 12/2006 | Olsen | | |
| 2007/0181447 | A1 * | 8/2007 | Olsen | ..... | 206/150 |

FOREIGN PATENT DOCUMENTS

| | | |
|---|---|---|
| EP | 0 748 744 A1 | 12/1996 |
| EP | 1 207 105 A1 | 5/2002 |

* cited by examiner

*Primary Examiner* — Anthony Stashick
*Assistant Examiner* — Ernesto Grano
(74) *Attorney, Agent, or Firm* — Pauley Erickson & Kottis

(57) ABSTRACT

A flexible carrier for carrying a plurality of containers that include a shoulder and a relatively narrower waist. The flexible carrier includes a flexible sheet having two rows of container receiving apertures formed therein. The plurality of containers are each placed into a respective container receiving aperture around the waist and are thus unitized in a package. The flexible carrier may further include an integrated handle.

11 Claims, 5 Drawing Sheets

CONTAINER CARRIER

CROSS REFERENCE TO RELATED APPLICATION

This Application claims the benefit of U.S. Provisional Patent Application Ser. No. 61/033,640, filed 4 Mar. 2008, and which is incorporated by reference herein and is made part hereof, including but not limited to those portions which specifically appear on this Patent Application.

BACKGROUND OF THE INVENTION

Field of the Invention

This invention relates to a flexible carrier for carrying a plurality of containers such as cans or bottles.

Description of Prior Art

Conventional container carriers are often used to unitize a plurality of similarly sized containers, such as cans, bottles, jars and boxes and/or similar containers that require unitization. Flexible plastic ring carriers are one such conventional container carrier.

Flexible plastic ring carriers may be used to unitize groups of four, six, eight, twelve or other suitable groups of containers into a convenient multipackage. Flexible ring carriers may include a handle that extend upwardly from the carrier to enable a consumer to carry the package.

Conventional manufacturing techniques permit contemporary containers to include dramatic shapes and contours to increase the shelf image, functionality and desirability of such containers. Such containers may include a wide diameter shoulder and a narrower waist area. As a result, containers having such unique shapes result in challenges to conventional container carrier design. Such challenges include applying container carriers to the containers and maintaining a tight, assembled package following application of the container carrier to the containers.

According to containers known in the prior art, for instance, a twenty ounce GATORADE plastic bottle, a shoulder diameter is approximately 2.8 inches and a waist diameter is approximately 2.4 inches resulting in a waist-to-shoulder increase of approximately 14%. The resulting shoulder circumference of this prior art container is approximately 8.8 inches. Such prior art containers are unitized with a flexible carrier having a container receiving aperture with a perimeter of 6.2-6.4 inches and a diameter of 2.2-2.4 inches.

SUMMARY OF THE INVENTION

The present invention is directed to a flexible carrier for packaging containers that includes an arrangement of container receiving apertures permitting application to containers having a large difference between a largest diameter and a smallest diameter.

According to preferred embodiments of this invention, each flexible carrier preferably includes two rows of container receiving apertures, each for receiving a container, to form a package. In addition, a handle is preferably connected between the rows of container receiving apertures. A plurality of struts may connect the handle with the flexible sheet between the rows of container receiving apertures, preferably between a centerline of the flexible sheet and the handle.

The resulting package preferably permits application to containers having a difference of 18-25% or more between a waist area where the flexible carrier is situated and a largest diameter of the respective container sidewall.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
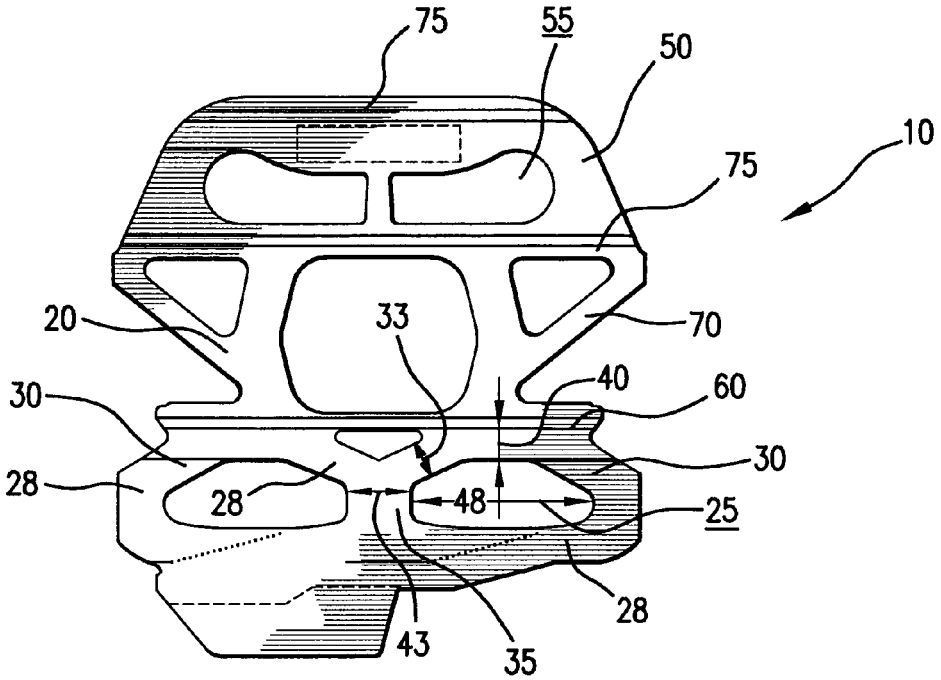
FIG. 1 is a side elevational view of a flexible carrier according to one preferred embodiment of this invention.
Figure 2:
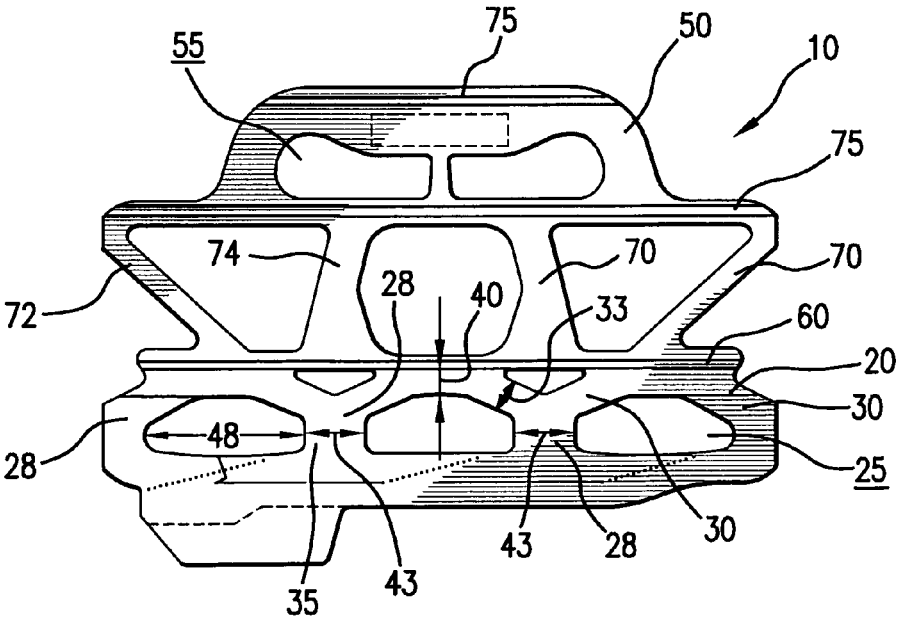
FIG. 2 is a side elevational view of a flexible carrier according to one preferred embodiment of this invention.
Figure 3:
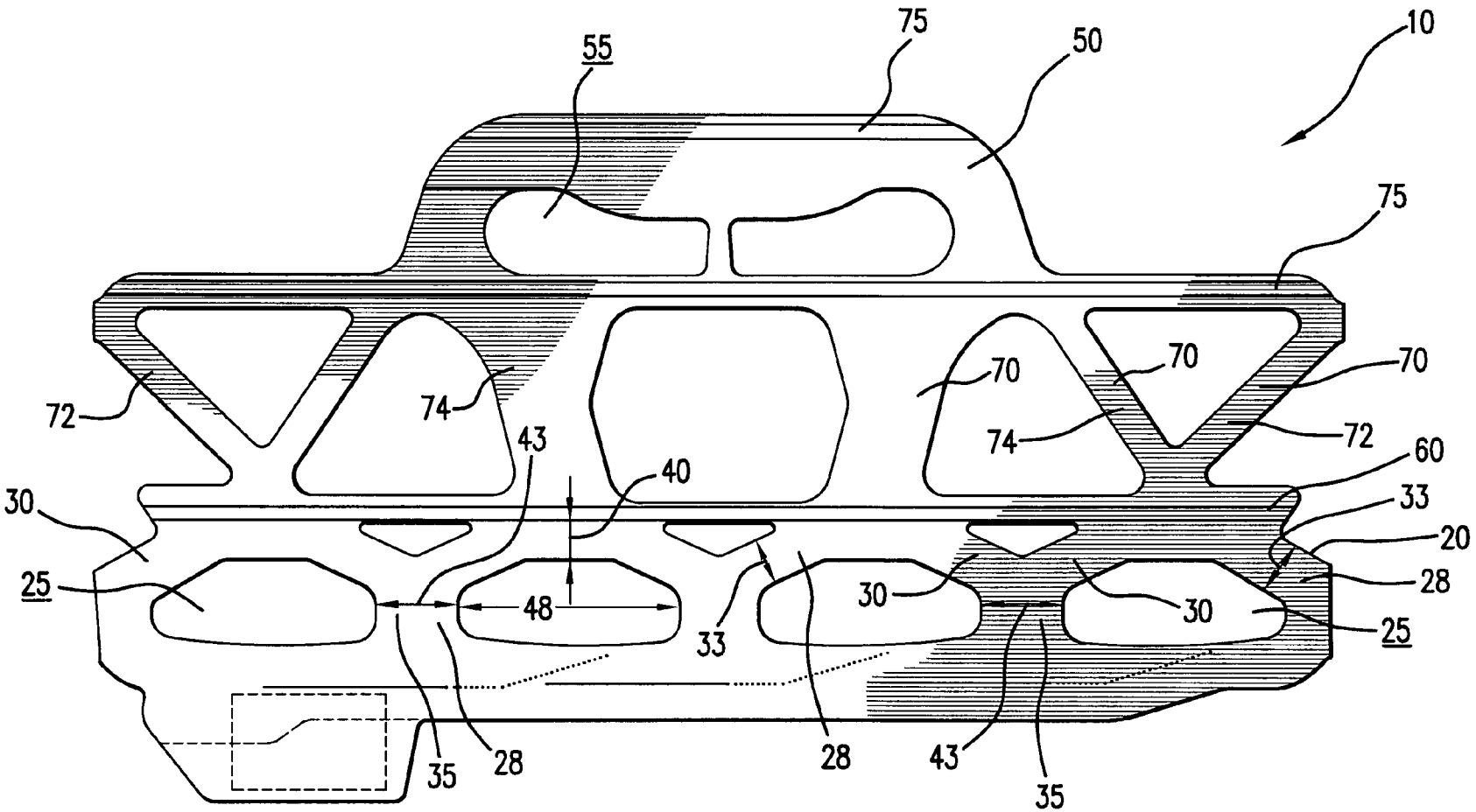
FIG. 3 is a side elevational view of a flexible carrier according to one preferred embodiment of this invention.
Figure 4:
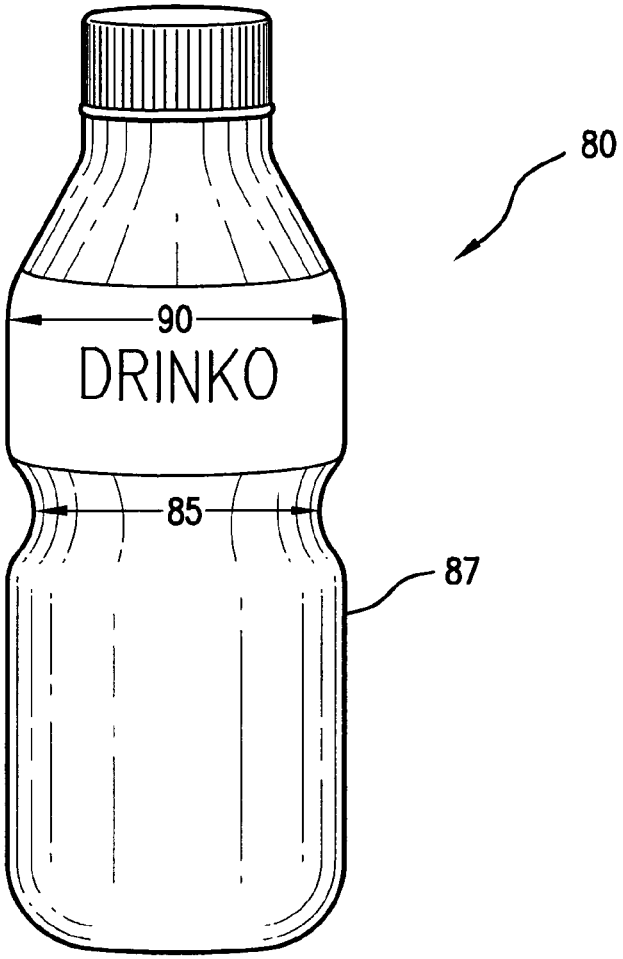
FIG. 4 is a front view of a container according to one preferred embodiment of this invention.
Figure 5:
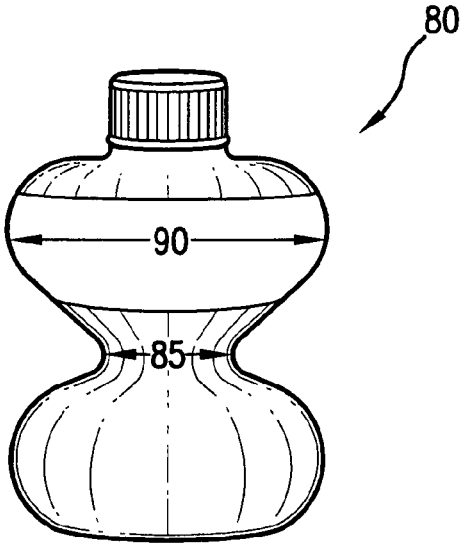
FIG. 5 is a front view of a container according to one preferred embodiment of this invention.
Figure 6:
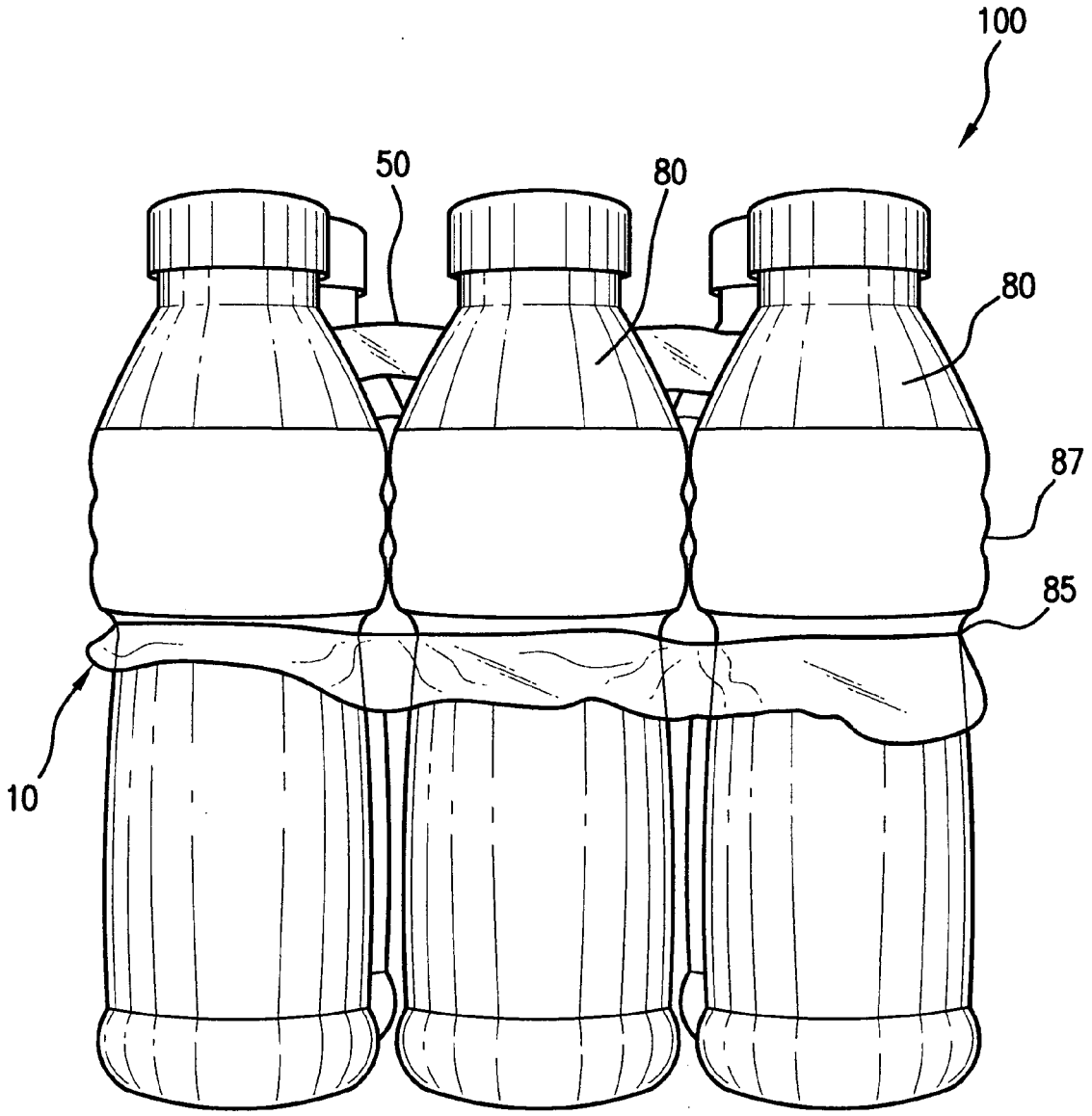
FIG. 6 is a side view of a package of containers according to one preferred embodiment of this invention.
Figure 7:
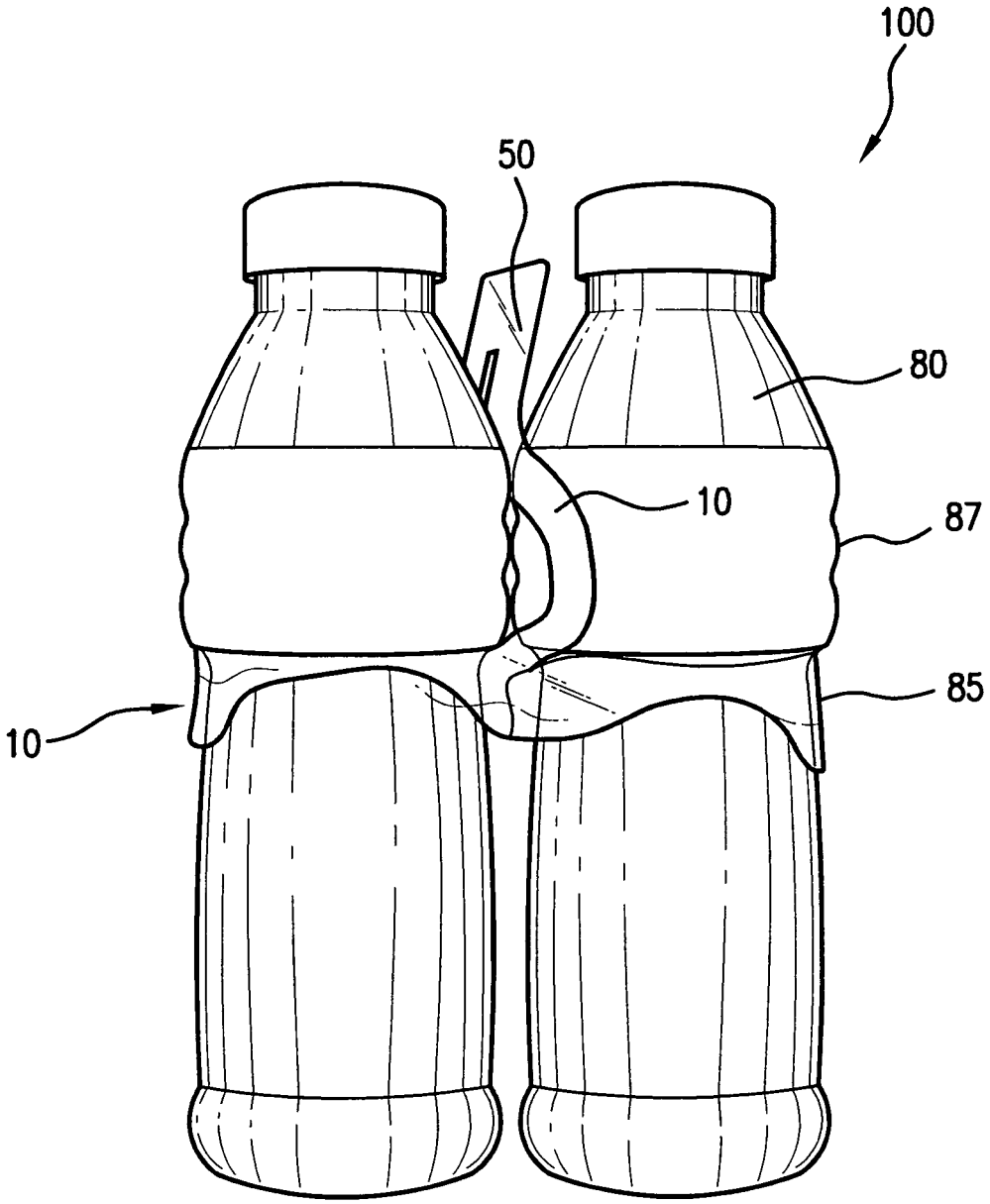
FIG. 7 is a front view of the package of containers shown in FIG. 6.

FIG. 1-3 shows flexible carrier 10 for unitizing four, six and eight containers, respectively, to form a unitized package. FIGS. 4 and 5 show containers 80 for unitization according to preferred embodiments of this invention and FIGS. 6 and 7 show a package of unitized containers. Although FIGS. 1-7 illustrate various structures for flexible carrier 10 of the invention, the illustrations are exemplary, and the invention is not limited to the flexible carriers 10 or packages shown. For example, flexible carrier 10 may be alternatively configured and used to unitize ten, twelve or any other desired number of containers 80.

Containers 80, such as those shown in FIGS. 4 and 5, are preferably bottles, more specifically bottles having contours and/or similar surface features. Such contours result in a sidewall 87 that includes a largest diameter 25% or more larger than a waist 85 of container 80. Although bottles are shown in FIGS. 4-7, cans or any other commonly unitized container may be used with flexible carrier 10 according to this invention. The containers are preferably, though not necessarily, like-sized within a single flexible carrier 10.

Each flexible carrier 10 preferably includes one or more layers of flexible sheet 20 having a width and length defining therein a plurality of container receiving apertures 25, each for receiving a container 80. The plurality of container receiving apertures 25 are preferably arranged in longitudinal rows and longitudinal ranks so as to form an array of container receiving apertures 25, such as two rows by two ranks for a four container multipackage as shown in FIG. 1; two rows by three ranks for a six container multipackage as shown in FIGS. 2 and 6; two rows by four ranks for an eight container multipackage as shown in FIG. 3, etc. Container receiving apertures 25 are preferably elongated in a longitudinal direction of flexible carrier 10.

According to one preferred embodiment of this invention, such as shown in FIGS. 1-3, two layers of flexible sheet 20 are connected along a longitudinally extending centerline 60. Centerline 60 as used herein generally describes a segment between rows of container receiving apertures 25 and/or between layers of flexible sheet 20. According to one preferred embodiment of this invention, centerline 60 comprises a weld that joins the two layers of flexible sheet 20. The two layers of flexible sheet 20 may be coextruded, welded, or otherwise joined together to create flexible carrier 10. "Weld" as used in the specification and claims may be defined as a hot weld, cold weld, lamination or any other manner of connection that joins two sheets of material known to those having ordinary skill in the art.

As shown in FIGS. 1-3, a row of container receiving apertures 25 is preferably formed on each side of centerline 60 and/or in each layer of the two layers of flexible sheet 20. As such, one row of container receiving apertures 25 is preferably formed along each side of the centerline 60. Accordingly, four container receiving apertures 25 are formed in flexible carrier 10 shown in FIG. 1, i.e. two overlapping rows of two container receiving apertures 25 each. Container receiving apertures 25 are preferably formed in a geometry that results in a tight unitization of containers 80 without excess play and/or sliding between and among containers 80 and flexible carrier 10. Such a result is difficult when carrier 10 is applied to containers 80 having unique sidewall contours and a relatively narrow waist 85.

As described herein and shown in FIGS. 4-7, containers 80 preferably include a contoured or non-uniform sidewall where shoulder 90 transitions into waist 85. Shoulder 90 is preferably a maximum diameter of container 80 and waist 85 is preferably a minimum diameter of container 80 or an area of container 80 where carrier 10 is positioned to form the unitized package of containers 80.

Prior art container carriers, such as for use with the GATORADE container described above, include a center distance between a centerline and an edge of the container receiving aperture of approximately 0.35 inches. A longitudinal distance between each container receiving aperture in the prior art carrier is approximately 0.76 inches and a oblique band width is approximately 0.37 inches. A longitudinal distance between adjacent container receiving apertures is approximately 32-35% of a diameter of the container receiving apertures in the prior art carrier. Additionally, the center distance is approximately 95% of the oblique band width. Finally, a perimeter of the prior art container receiving apertures stretch approximately 38-41% over the perimeter of the shoulder of the prior art containers.

According to containers 80 as used in connection with the subject invention, for instance, container 80 shown in FIG. 4, container 80 includes shoulder 90 of 2.6 inches in diameter and waist 85 of 2.0 inches in diameter. As a result of this geometry, waist 85 is approximately 23% smaller than shoulder 90. The corresponding circumference of shoulder 90 of container 80 shown in FIG. 4 is approximately 8.17 inches. According to another preferred embodiment, container 80 shown in FIG. 5 includes shoulder 90 of 2.45 inches in diameter and waist 85 of 1.72 inches in diameter. As a result of this geometry, waist 85 is approximately 30% smaller than shoulder 90. The corresponding circumference of shoulder 90 of container 80 shown in FIG. 5 is approximately 7.70 inches.

As described above, container carrier 10 according to a preferred embodiment of the invention includes a series of interconnecting webs 28 that define the plurality of container receiving apertures 25. Webs 28 are stretchable around shoulder 90 of container 80 and recoverable around waist 85 of container 80, whereby the waist is at least 18% smaller than the shoulder. According to one embodiment, waist 85 is at least 25% smaller than shoulder 90.

As described, centerline 60 extends longitudinally across carrier 10 and defines a center distance 40 between centerline 60 and a central edge of each container receiving aperture 25. In addition, a pair of oblique bands 30 extend at an angle generally from centerline 30 and define edges of each container receiving aperture 25. According to a preferred embodiment of this invention, each oblique band width 33 is wider than center distance 40. Specifically, as shown in FIG. 2, center distance 40 is approximately 0.37 inches and oblique band width 33 is approximately 0.45 inches resulting in center distance 40 that is approximately 82% of oblique band width 33. According to a preferred embodiment of this invention, center distance 40 is less than 90% of oblique band width 33.

As shown in FIGS. 1-3 a longitudinal distance 43 between each container receiving aperture 25 is at least approximately 30% of a width 48 of each container receiving aperture 25. As shown in FIGS. 1-3, a longitudinal distance 43 between each container receiving aperture 25 is approximately 0.80 inches and the width 48 of each container receiving aperture 25 is approximately 2.04 inches to 2.14 inches thereby resulting in a longitudinal distance 43 of approximately 37-39% of the width 48 of each container receiving aperture 25. In addition, carriers 10 shown in FIGS. 1-3 preferably include container receiving apertures 25 having perimeters of approximately 4.96-5.48 inches.

Following application to a plurality of containers 80, a perimeter of container receiving aperture 25 stretches more than 50% during application around shoulder 90 of container 80. According to one preferred embodiment, the perimeter of container receiving aperture 25 stretches more than 60% during application around shoulder 90 of container 80. According to another preferred embodiment, the perimeter of container receiving aperture 25 stretches more than 70% during application around shoulder 90 of container 80. According to a particular embodiment of the invention, such as carrier 10 shown in FIG. 2 applied to container 80 shown in FIG. 4, container receiving apertures 25 stretch more than 55% during application.

As shown in FIG. 4, waist 85 may comprise a diameter 25% of more smaller than a diameter of a widest portion, or shoulder 90, of sidewall 87 of container 80. During application to containers 80, carrier 10 is stretched to engage with container receiving apertures 25 with each respective container 80. In an embodiment wherein carrier 10 is stretched onto containers 80 having unique dimensional requirements, such as a relatively narrow waist 85, much of the stretch taking place occurs in oblique bands 30 surrounding container receiving apertures 25. As described, container receiving apertures 25 must first overcome stretch over shoulder 90 before settling and recovering into waist 85 of container 80.

According to a preferred embodiment of this invention, oblique bands 30 are relatively wide to accommodate extra stretch. Preferably, oblique bands 30 are wider than a center distance 40 between centerline 60 and an inner edge of container receiving aperture 25. As a result, the inner portion of container receiving apertures 25 may be stretched beyond elastic (or neckdown) at an inside periphery or circumference of each container receiving aperture 25, but oblique bands 30 themselves are wide enough to accommodate the extra stretch without suffering neckdown in webs 28. Oblique bands 30 are preferably aligned generally in a "machine direction" of flexible sheet 20. Such alignment permits more stretch than if oblique bands 30 were entirely in a transverse direction of flexible sheet 20 or were aligned at more than 45 degrees to horizontal. Much of the rest of the stretch is generally located in transverse bands 35. Preferably, transverse bands 35 are significantly wider than oblique bands 30 to accommodate high stress without neck-down and yet maintain containers 80 is a separate, tight and aligned manner in the machine direction.

As shown in FIGS. 1-3, according to one preferred embodiment of this invention, handle 50 is formed along the centerline 60 between the two rows of container receiving apertures 25 and, following application to containers in a separate plane from the two rows of container receiving apertures 25. Specifically, as shown in FIG. 1, handle 50 is connected along a side of the row of container receiving apertures 25, and is preferably connected with respect to centerline 60, such as a weld. Handle 50 may be integrally formed with flexible sheet 20 or may be separately formed and attached relative to flexible sheet 20.

Handle 50 may comprise one or more elongated apertures 55 positioned along the outer periphery of handle 50 or may comprise a similar configuration that provides an ample area for a consumer to grasp by inserting his hand through and still maintain the purpose and integrity of package 100.

As best shown in FIG. 1, a plurality of struts 70 connect handle 50 with the rows of container receiving apertures 25, preferably between centerline 60 and handle 50. In the two layer of flexible sheet 20 embodiment of the subject invention, struts 70 are preferably formed in both layers of flexible sheet 20 and one or more handle welds 75 may be positioned longitudinally across handle 50. The plurality of struts 70 may comprise inner struts 74 located across internal portions of flexible carrier 10 and outer struts 72 located across a periphery of flexible carrier 10.

As shown in FIGS. 6 and 7, package 100 resulting from flexible carrier 10 includes a plurality of unitized containers 80. Flexible carriers 10 are generally applied to containers 80 by stretching flexible sheet 20 surrounding container receiving apertures 25 around shoulder 90 or otherwise around a maximum perimeter of container 80, and requiring the stretched carrier 10 to recover, thereby providing a tight engagement. According to a preferred embodiment of this invention, carrier 10 is applied to a waist 85 of container 80. As used herein, waist 85 is defined as a narrower diameter along a sidewall of container 80 that may include one or more contours from top to bottom.

The tightness of the resulting package is particularly important in the moments immediately after carrier 10 is released onto container 80 around waist 85. During these moments, carrier 10 is fanned out at centerline 60 and divided from a trailing, adjacent carrier and then turned and diverted, all at speeds of up to 1200 containers per minute without twisting or falling over. As a result, the immediate recovery of container 80 around waist 85 is important to the integrity of the resulting package 100.

As a result of the described geometry of carrier 10, container receiving apertures 25 are capable of elongation of over 50% and more preferably 60% and potentially 70% and up to 80% or more. Particularly, at least band 30, 35 portions of carrier 10 are capable of stretch of 80% or more during application to a plurality of containers 80. Such elongation is required by containers 80 having sidewall contours and/or waist 85 dimensions that require overstretch of oblique bands 30 during application to containers 80 and then recovery around waists 85 of the respective containers 80 to maintain a package 100 having a plurality of tightly arranged containers 80 in carrier 10.

As a result of the described configuration in one preferred embodiment of this invention, two layers of flexible sheet 20 joined with the longitudinally extending centerline 60 include a row of container receiving apertures 25 formed in each layer of the two layers of flexible sheet 20. One row of container receiving apertures 25 is formed on each side of centerline 60 resulting in flexible carrier 10 fanning out at centerline 60 to permit a generally flat plane of engagement within which containers 80 are inserted. Handle 50 preferably extends in a different plane from flexible sheet 20 in this configuration at application, as best shown in FIG. 7. In this manner, each row of container receiving apertures 25 engages a respective row of containers 80 to form package 100.

Handle 50 suitable for manual grasping preferably extends from an approximate middle of flexible sheet 20. In package 100 according to one preferred embodiment of this invention, handle 50 preferably extends upwardly from centerline 60 and between each row of container receiving apertures 25. Handle struts 70 permit proper separation between centerline 60 and handle 50 to permit a comfortable grasping area within package 100. As such, package 100 may be carried by manually grasping handle 50 extending upwardly from package 100.

A related method of packaging multiple containers 80 with carrier 10 to form a unitized packages includes providing containers 80 to an applicating machine (not shown). Such applicating machines typically include a rotating drum with a plurality of jaw pairs for engaging carrier 10. Carrier 10 is moved through the applicating machine and positioned over shoulder 90 of container 80 and downward to waist 85 of container 80 whereby waist 85 is at least 18% smaller than shoulder 90. Carrier 10 is then released around waist 85 of each container 80 to form the unitized package.

According to a preferred embodiment, as each group of containers 80 arrives below the rotating drum, a pitch, or distance between central axes of adjacent containers is approximately 3 inches. Following application of carrier 10 to the group of containers, the pitch becomes approximately 2.6 inches. In a carrier 10 comprising two rows of four containers each, the overall footprint is approximately 12 inches prior to application and becomes approximately 9.8 inches following application.

While in the foregoing specification this invention has been described in relation to certain preferred embodiments thereof, and many details have been set forth for purpose of illustration, it will be apparent to those skilled in the art that flexible carrier 10 and package 100 are susceptible to additional embodiments and that certain of the details described herein can be varied considerably without departing from the basic principles of the invention.

The invention claimed is:

1. A carrier having a plurality of container receiving apertures for unitizing a plurality of containers, the containers having a shoulder diameter and a waist diameter, the carrier comprising:

a series of interconnecting webs that define the plurality of container receiving apertures, the webs stretchable around the shoulder diameter of the container and recoverable around the waist diameter of the container, whereby the waist diameter is 23-30% smaller than the shoulder diameter;

a weld extending longitudinally across the carrier between two longitudinal rows of the container receiving apertures, a center distance defined between the weld and an inner edge of each container receiving aperture, wherein the inner edge is a generally straight segment parallel to the weld; and a pair of oblique bands extending from the weld that define each container receiving aperture, wherein an oblique band width is wider than the center distance resulting in inner portions of the container receiving apertures stretching beyond an elastic state at an inside periphery of each container receiving aperture while the oblique bands accommodate the stretching and recovery without suffering neckdown in the interconnecting webs.

2. The carrier of claim 1 wherein the center distance is 70-90% of the oblique band width.

3. The carrier of claim 1 wherein a longitudinal distance between each container receiving aperture is at least approximately 30-41% of a width of each container receiving aperture.

4. The carrier of claim 1 wherein a longitudinal distance between each container receiving aperture is approximately 37-41% of a width of each container receiving aperture.

5. The carrier of claim 1 wherein a perimeter of the container receiving aperture stretches 50%-80% during application around the shoulder diameter of the container.

6. The carrier of claim 1 wherein a perimeter of the container receiving aperture stretches 60%-80% during application around the shoulder diameter of the container.

7. The carrier of claim 1 wherein a perimeter of the container receiving aperture stretches 70%-80% during application around the shoulder diameter of the container.

8. A package of unitized containers comprising:

a plurality of containers having a shoulder diameter and a waist diameter wherein the waist diameter is at least 23-30% smaller than the shoulder diameter;

a carrier having a series of interconnecting webs that define a plurality of container receiving apertures, wherein the webs pass over the shoulder diameter of each container and engage the waist diameter of the container resulting in each container receiving aperture engaged with a container of the plurality of containers;

a weld extending longitudinally across the carrier between two longitudinal rows of the container receiving apertures, a center distance defined between the weld and an inner edge of each container receiving aperture, wherein the inner edge is a generally straight segment parallel to the weld; and a pair of oblique bands extending from the weld that partially define each container receiving aperture, wherein an oblique band width is wider than the center distance resulting in inner portions of the container receiving apertures stretching beyond an elastic state at an inside periphery of each container receiving aperture while the oblique bands accommodate the stretching and recovery without suffering neckdown in the interconnecting webs.

9. The package of claim 8 wherein the center distance is 70-90% of the oblique band width.

10. The package of claim 8 wherein a perimeter of the container receiving aperture stretches 50-80% during application around the shoulder diameter of the container.

11. The package of claim 8 wherein a perimeter of the container receiving aperture stretches 70-80% during application around the shoulder diameter of the container.

* * * * *